US005388310A

United States Patent [19]

Haworth

[11] Patent Number: 5,388,310

[45] Date of Patent: Feb. 14, 1995

[54] AUTOLEVELLING METHOD AND APPARATUS

[75] Inventor: Walter Haworth, Lancashire, United Kingdom

[73] Assignee: John D. Hollingsworth on Wheels, Inc., Greenville, S.C.

[21] Appl. No.: 169,689

[22] Filed: Dec. 17, 1993

[30] Foreign Application Priority Data

Dec. 21, 1992 [GB] United Kingdom ..... 9226594

[51] Int. Cl.[6] ..... D01G 15/64; D01H 5/42

[52] U.S. Cl. ..... 19/65 A; 364/470; 19/239

[58] Field of Search ..... 19/65 A, 105, 157, 239, 19/300; 364/470, 563, 575

[56] References Cited

U.S. PATENT DOCUMENTS 3,384,933 5/1968 Yamamoto et al. ..... 19/65
4,054,786 10/1977 Vincent ..... 364/575
4,928,257 5/1990 Yerkes et al. ..... 364/575 X
4,974,296 12/1990 Vidler ..... 19/239
5,010,494 4/1991 Lord ..... 19/239 X
5,068,818 11/1991 Uramoto et al. ..... 364/575
5,134,755 8/1992 Jornot et al. ..... 364/470 X
5,152,033 10/1992 White ..... 19/105
5,289,381 2/1994 Demuth et al. ..... 364/470

FOREIGN PATENT DOCUMENTS 0354653 2/1990 European Pat. Off. .
2062704 5/1991 United Kingdom ..... 19/239

OTHER PUBLICATIONS

Patent Abstracts of Japan, vol. 013, No. 589 (C-670)(3937), 25 Dec. 1989, JP-A-01 246 422 (Daiwabo Co. Ltd.) 2 Oct. 1989 (Abstract).

*Primary Examiner*—Clifford D. Crowder
*Assistant Examiner*—John J. Calvert
*Attorney, Agent, or Firm*—Leatherwood Walker Todd & Mann

[57] ABSTRACT

An autoleveller derives the signal for its draft correction from an averaged value of the sliver weight or thickness signals in each of a plurality of unit lengths of the sliver path. A preferred embodiment uses upstream and downstream sliver weight or thickness measuring means to derive signals for a draft correction and the gain of a draft correction made in response to the first sliver measuring means is varied in response to the averaged signal from the second sliver measuring means.

15 Claims, 2 Drawing Sheets

AUTOLEVELLING METHOD AND APPARATUS

FIELD OF THE INVENTION

The present invention relates to an autoleveller for use in monitoring the uniformity of the weight or thickness of a sliver, either integrated as part of a card, or as a free-standing autoleveller, for example for use with a draw frame.

PRIOR ART

It has previously been proposed to connect a coiler downstream of an autoleveller, with measuring means in the coiler head to provide a way of monitoring the performance of the upstream autoleveller. Such an arrangement is, for example, described in EP-A-0544425. The autoleveller in question is normally of the open-loop type.

Traditionally an autoleveller includes means for measuring the instantaneous sliver thickness or weight and means for controlling the draft applied so as to correct any thickness deviations. In the case of an open loop autoleveller allowance will be made for the time delay between passage of a particular part of the sliver through the measuring means and arrival of that part of the sliver at the centre of the drafting zone.

U.S. Pat. No. 4,653,153 discloses open loop autolevellers and closed loop autolevellers, and one form of combined open loop and closed loop autoleveller where the open loop autoleveller is able to respond to high frequency (short wavelength) variations in the thickness and the closed loop downstream sensing means provides a way of correcting the performance of the open loop autoleveller for longer wavelength errors based on an instantaneous downstream measurement of thickness of the output sliver from the open loop autoleveller. Indeed, the description of U.S. Pat. No. 4,653,153 even refers to the possibility of selecting particular wavelengths and analysing the data from the thickness sensing means to identify all thickness variations exhibiting the chosen wavelength for tuning out that particular wavelength variation.

OBJECT OF THE INVENTION

It is an object of the present invention instead to sense the thickness variations for autolevelling a sliver by averaging out the thickness measurements over a known length of sliver and applying a draft correction based on that averaged value.

SUMMARY OF THE INVENTION

Accordingly, one aspect of the present invention provides an autoleveller comprising drafting means for drafting a sliver to be autolevelled; first sliver thickness or weight measuring means in the sliver path through the autoleveller; means for varying the draft of said drafting means for correcting variations in thickness sensed by said first measuring means; control means for controlling said draft varying means in response to the signal from said first sliver thickness or weight measuring means; and second sliver thickness or weight measuring means downstream of said drafting means; characterized by the fact that said control means includes averaging means, responsive to said second measuring means, to average out the sliver thickness or weight signal over a known length of the sliver for determining drift in the thickness or weight of the drafted sliver; and by the fact that said draft varying means are responsive to the averaged value from said averaging means.

A second aspect of the present invention provides a method of autolevelling comprising measuring the weight or thickness of a sliver; effecting a sliver weight or thickness correction by changing the draft on the sliver in response to the measured weight or thickness; and varying the gain of the sliver thickness or weight correction in response to a measurement of the thickness or weight of the sliver after drafting; characterized in that the variation of the gain of the thickness or weight correcting draft of the sliver is effected in response to the average of said measured weight or thickness over a predetermined length of the sliver path.

BRIEF DESCRIPTION OF THE DRAWINGS

In order that the present invention may be more readily understood, the following description is given, merely by way of example, with reference to the accompanying drawings, in which.

DETAILED DESCRIPTION OF THE PREFERRED EMBODIMENT

It will, of course, be understood that the present invention provides, as an alternative, the autolevelling combination in conjunction with a downstream sliver monitor, not necessarily in a coiler feed, and without the need for the autoleveller to be connected directly at the outlet of the web condensing means of the card. It may, for example, be used for autolevelling the output of a drawframe.

Figure 1:
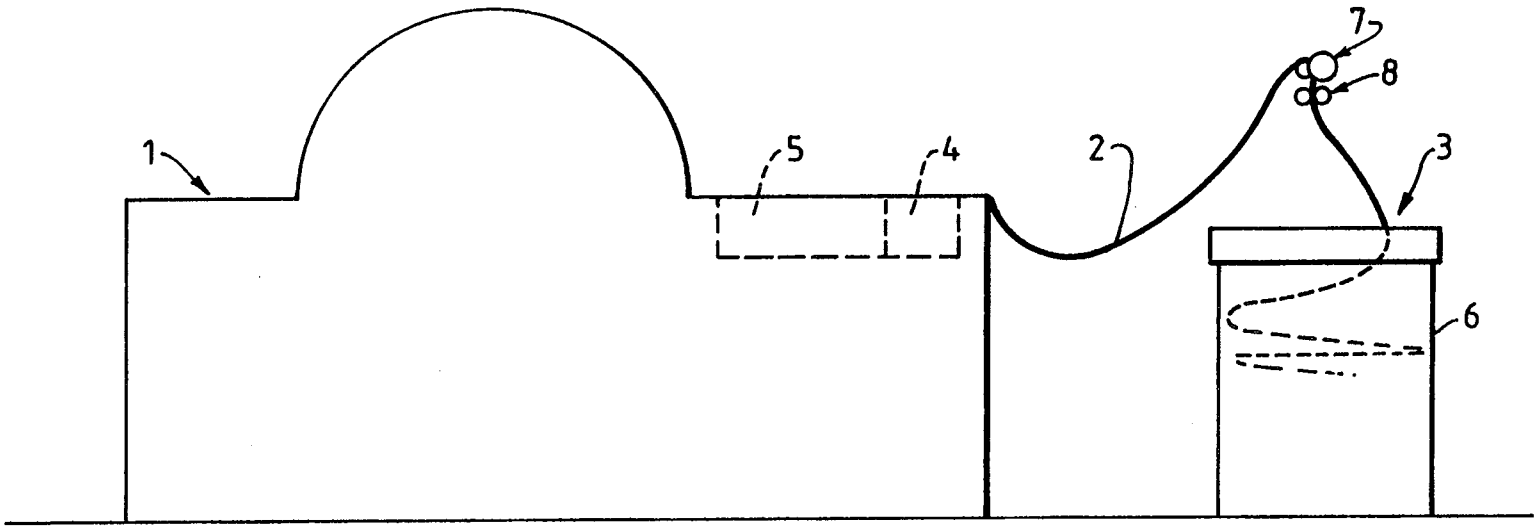
FIG. 1 is a schematic side elevation of a card and coiler combination incorporating an autoleveller in accordance with the present invention.

The card 1 in FIG. 1 has the delivered sliver 2 advanced to a coiler 3 after having passed through an open loop autoleveller 4 just downstream of the web condenser 5. At the coiler the sliver is coiled into a can 6 after having passed through a first pair 7 of rollers which are in fact a tongue and groove sliver thickness measuring pair, and a second downstream pair of calender rollers 8 whose function it is to guide the sliver from the tongue and groove measuring pair 7 substantially without draft. If desired, some other form of guide means may be used in place of the second pair 8 of calender rollers at the second sliver monitoring means.

Figure 2:
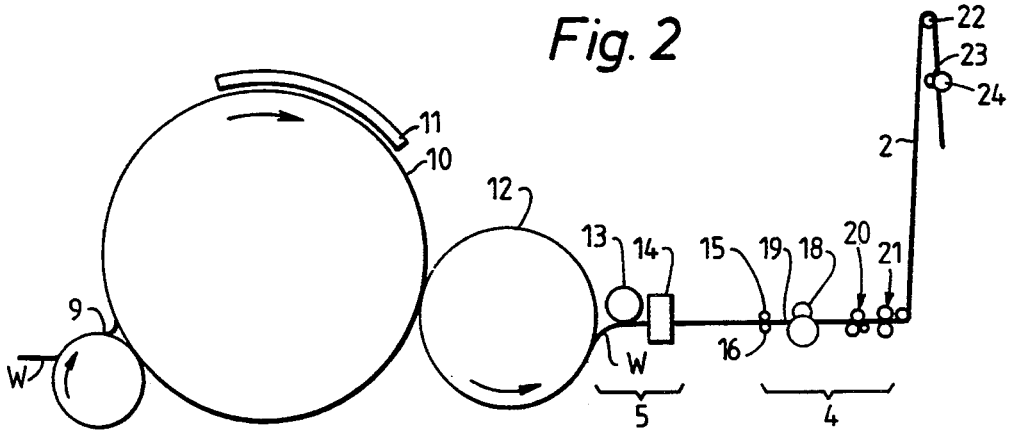
FIG. 2 is a schematic side view of the various carding cylinders, drafting rollers, measuring means and sliver path of FIG. 1.

FIG. 2 shows, in more detail, the working elements of the card, of the web condenser section 5, and of the autoleveller 4, as well as showing the tongue and groove measuring roller pair 7 of the coiler.

In FIG. 2, a feed web W is first of all presented to the licker-in 9 which then transfers it to the carding cylinder 10 rotating in a clockwise direction to effect carding by cooperation with at least one concave carding plate 11 which will be provided with card clothing (not shown). The staple fibre web then passes to a doffer 12 which presents it to a fluted stripping roll 13 of the doffing mechanism from which it arrives on a pair of horizontally moving but vertically aligned runs of a belt conveyor system 14 to condense the web inwardly to form a sliver 2.

Between the web condenser section 5 and the autoleveller 4, there is a pair of calender rollers 15,16 which are optional and which present the condensed sliver to the autoleveller tongue and groove rollers 18,19.

Upon entry into the autoleveller 4, the web first of all passes from the calender rollers 15,16 between the tongue roller 18 and groove roller 19 where the thickness of the sliver is measured in the conventional manner, before the sliver then passes into drafting means, in this case comprising a $\frac{2}{3}$ drafting set comprising a first set 20 of an upper roller cooperating with a pair of lower rollers, and a final drafting nip at a roller pair 21. The speed of rotation of the final drafting nip 21 is varied in order to carry out a self-levelling action to restore the thickness or weight of the finished sliver to a target value, the deviation from the target value having been determined by the tongue and groove roller pairs 18 and 19.

In the coiler, the sliver 2 first of all passes over a guide roller 22 and then to the tongue and groove roller pair 7 comprising the tongue roller 23 and the groove roller 24 shown in FIG. 2.

In order to allow the finished sliver to be still more accurately controlled, it is proposed in accordance with the present invention to compare, in the autoleveller, the sliver thickness error signal measured at the roller pair 7 downstream of the drafting means 20,21 with that measured at the first measuring rollers 18,19 for smoothing out variations in the sliver thickness by varying the gain of the open-loop system.

Figure 3:
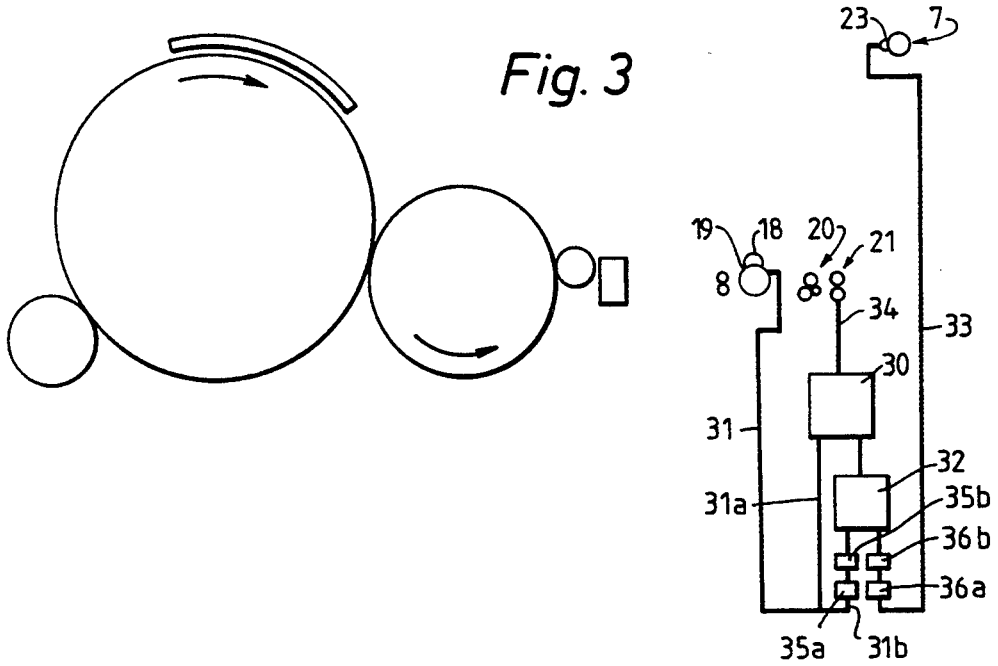
FIG. 3 corresponds to FIG. 2 but shows the control units and the signal lines to and from them.

FIG. 3 shows the control system for the final drafting roller pair 21 as comprising a draft control unit 30 having a first input 31*a* from a line 31 deriving a sliver thickness measuring signal from the tongue roller 18 of the first sliver thickness measuring means in the autoleveller, and a second input from a comparator 32 which itself has a first input 31*b* from the line 31 (from the tongue roller 18) and a second input from a line 33 carrying a control signal from the tongue roller 23 of the second sliver thickness measuring means 7.

The draft control unit 30 provides an output 34 to impose a draft correction on the final drafting nip 21 with a predetermined gain value, in response to deviation of the sliver thickness signal on line 31 from a reference value generated by the control unit 30. The output of the comparator 32 imposes a "fine-tuning" on the draft correction signal on line 34, by changing the gain of the draft control unit 30 responsive to the difference between the sliver thickness error indicated by thickness measurement signals on lines 31*b* and 33. The draft control signal line 34 can then impose a more accurate single speed control on the final drafting nip 21 to reflect any underlying trend towards overcorrection or undercorrection resulting from the use of a predetermined gain value (which is most appropriate only very close to the target sliver thickness or weight).

The open-loop control of the draft in the autoleveller 4 is such that when the nip between the tongue roller 18 and the groove roller 19 increases, due to a transient thickness increase in the sliver 2 passing therebetween, the gain of the autoleveller should result in the speed of rotation of the rollers at the final drafting nip 21 being increased by an amount sufficient to ensure that when that locally thicker part of the sliver arrives in the run between the roller set 20 and the final drafting set 21, its draft will be increased sufficient to restore a target value of the thickness. Likewise, if a reduction in sliver thickness at the sensing means 18,19 is sensed, then at the designed gain the draft between roller sets 20 and 21 should be reduced to restore the target value when that particular part of the sliver arrives there.

However, in accordance with this invention, the feedback of a thickness or weight signal from the second measuring means 7 allows the thickness error of the finished sliver entering the coiler can to be compared with the thickness error value simultaneously measured at the first measuring means, 18, 19, preferably by averaging the thickness or weight errors at each location over a long sample length of sliver (e.g. 100 meters) thereby allowing the trend in sliver thickness change to be evaluated and corrected by a change in the gain of the control unit 30.

If Td is the downstream thickness as measured by the second measuring means 7, Tu is the upstream thickness measured by the upstream measuring means 18, 19, T'u is the upstream target thickness, and T'd is the target downstream thickness, then the fractional input error can be calculated as $$\frac{Tu - T'u}{T'u}$$

$$\left(\text{i.e.} \quad e_i = \frac{Tu}{T'u} - 1\right)$$

Likewise, the fractional output error $$e_o = \frac{Td - T'd}{T'd} = \left(\frac{Td}{T'd} - 1\right).$$

The ideal situation is for the fractional output error $e_o$ to be zero.

When $e_o$ and $e_i$ have the same polarity, there has been under-correction so the gain of the open loop control unit operating the draft must be increased.

On the other hand, when $e_o$ and $e_i$ have opposite polarities there has been over-correction so the gain needs to be reduced.

In other words, while (i) the final drafting nip 21 carries out relatively rapid response open loop primary correction of draft on a length of sliver between roller sets 20 and 21 which will aim to return to target value T'd the thickness Td of a sliver, which was measured at the upstream measuring means 18,19 as having a thickness Tu different from the upstream target thickness T'u, (ii) there will be superimposed on this correction a "fine-tuning" correction derived from a comparison of the instantaneous values of fractional upstream (input) thickness error $$e_i = \frac{Tu}{T'u} - 1$$

based on the upstream thickness Tu measured by the first measuring means, 18,19, and the fractional downstream (output) thickness error $$e_o = \frac{Td}{T'd} - 1$$

based on the downstream thickness Td measured by the second measuring means 7. This should ensure that any tendency towards variation of the sliver thickness should be eliminated and any tendency towards overcorrection by the autoleveller primary correction action will be minimised.

It has been found that the measuring action of the tongue roller 23 and the groove roller 24 in the coiler head, downstream of the already accurate autoleveller 4, provides a very high degree of accuracy of measurement because of the uniform presentation of the fibres in the sliver at the measuring means 7. The result is such that values noted from a measurement at the measuring means 7 are very closely in agreement with values measured "off-line" in the quality control laboratory on random samples taken from the production sliver.

By feeding back this instantaneous "on-line" thickness signal on entry into the can 6, it is possible to improve still further on the accuracy of the sliver control, so as to achieve what is virtually a closed-loop control efficiency but still using the more rapid response open-loop system in that the measurements taken are both upstream and downstream of the drafting means 20,21 of the autoleveller and are only used to create a difference value which is effectively a "trend" in variation of the thickness error, rather than a single thickness error per se.

It has been found that the degree of accuracy obtainable with the dual measuring system 18,19 and 23,24 is adequate to permit quality yarns to be obtained after ring-spinning of the product sliver out of the can 6.

The advantages derived from the use of a system in accordance with the present invention are not simply that the accuracy can be greater, but that in fact the operation of the autoleveller can be "self-verifying" in such a way that it is possible to eliminate dependency on the skill of the operator which was a factor in governing the overall efficiency of the autoleveller without downstream measuring. Furthermore, the settings for the speed values can be maintained without the need for constant tuning by the operator in response to feedback from the quality control "off-line" laboratory testing.

Sources of imperfections which are no longer so pronounced with the downstream measuring proposed in accordance with the present invention are as follows:

(a) The thickness or weight measurement of a sliver in the autoleveller (for example at the tongue and groove roller pair 18,19, or at any alternative thickness measuring system which may be used in the autoleveller) may, in practice, be non-linear, such that at a target thickness or weight the value may be accurate but that the greater the thickness or weight error the less accurate will be the measurement taken.

(b) The imposed draft may not exactly equal the mechanical draft decided in terms of the speed ratios of the drafting nips.

Although both the first sliver thickness measuring means (18,19) and the second sliver thickness measuring means (23,24) are incorporated in terms of tongue and groove roller pairs in the illustrative embodiment of the present invention, it is of course possible for the thickness values to be determined by some alternative means such as a capacitive measuring means or sonic measuring means, or even to use sliver weight measuring means. However, the tongue and groove roller pair measuring means are preferred.

The data handling effected to derive the sliver thickness or weight error values for the inputs to the comparator 32 involves a respective sampling unit **35*a*,36*a* integrating the thickness and weight value for each unit length (e.g. 1 meter) passing through the measuring roller nip (at 18,19 or 23,24) and then a respective averaging unit 35*b*, 36*b* for storing the last 100 meter lengths sampled and for averaging the most recent 100 such stored values so as to average, continuously, the thus integrated values for the past (in this case 100) samples first taken. As sliver travels along the sliver path shown in FIG. 2** the values stored from the last 100 meters of travelling sliver will always represent the same 100 meter length of the sliver path.

In practice, the value Tu used in calculating the fractional input thickness error $e_i$ is the average value of 100 separate integrated thickness values over a continuous sequence of 100 one meter samples, and the downstream thickness Td used to calculate the fractional output thickness error is the average of 100 separate integrated downstream thickness values corresponding to 100 consecutive 1 meter samples.

The error values compared are then effectively average error values effective over a 100 meter sample and provide a measure of compensation for variation but in the open loop manner (as opposed to the slower acting closed loop principle of known long term autolevellers).

This long term sampling can ensure that the same length of sliver has been present at both the upstream sensing nip 18,19 and the downstream nip 23,24 during the sampling period taken.

The gain control may be a fixed increment polarised dependent on the sign (+ or −) of the error compensation or may be an analogue of the magnitude of the error compensation, again polarised dependent on the sign.

In the above description there is mention of the sampling technique involving averaging out the sliver thickness or weight signals over a known sliver path length (e.g. 100 meters) in order to derive an autolevelling signal. Whereas traditionally the autoleveller aims to smooth out long and short wavelength transient variations in order to provide a relatively stable thickness to the sliver, this new technique enables correction of long term drift in the output sliver thickness or weight to be corrected.

I claim:

1. An autoleveller for drafting sliver along a sliver path, comprising:

drafting means for drafting a sliver to be autolevelled;

first sliver thickness measuring means associated with the sliver path for sensing the thickness of sliver in the sliver path and for generating sliver thickness signals responsive thereto;

draft varying means connected to said first sliver thickness measuring means and said drafting means for varying the draft of said drafting means to correct sliver thickness variations sensed by said first sliver thickness measuring means;

control means associated with said draft varying means for controlling said draft varying means in response to the signals from said first sliver thickness measuring means;

second sliver thickness measuring means associated with the sliver path for sensing the thickness of sliver in the sliver path and for generating sliver thickness signals responsive thereto;

averaging means associated with said draft varying means and responsive to said second sliver measuring means for averaging sliver thickness signals over a known length of the sliver path, said averaging means generating averaged thickness values responsive to the averaging of said sliver thickness signals generated by said second sliver measuring means, for detecting a signal drift in the thickness of the drafted sliver; and said draft varying means being additionally responsive to said averaged thickness values signals from said averaging means for varying said drafting means responsive to said averaged thickness values.

2. An autoleveller according to claim 1, wherein said control means further includes sampling means for integrating the sliver thickness values in each of a succession of n unit lengths making up said known sliver path length, and storing means associated with said control means for storing the various integrated sliver thickness signals of the immediately preceding said n unit lengths to have been processed by said sampling means; and wherein said averaging means average the integrated sliver thickness values stored in said storing means.

3. An autoleveller according to claim 1, wherein said control means are responsive to said first sliver measuring means for controlling the draft of said drafting means in an open loop manner in response to variation between said averaged thickness values and a target thickness value; and wherein said control means develops a gain signal variable in response to said averaged thickness values of said second sliver thickness measuring means, said control means developing a draft correction signal, and the gain of said draft correction signal is adjusted responsive to said averaged thickness values of variations in sliver thickness.

4. An autoleveller according to claim 3, further comprising a comparator associated with said control means, wherein said gain of said draft correction signal is responsive to said comparator and derives a gain adjustment from the difference between input sliver thickness values sensed at said first sliver thickness measuring means and output sliver thickness values sensed at said second sliver thickness measuring means.

5. An autoleveller according to claim 4, wherein said input sliver thickness values are average error values derived by said sampling means integrating the input sliver thickness values of said first sliver thickness measuring means over each of a plurality of said equal sliver path unit lengths, and averaged by said averaging means operating on the integrated values outputted from said sampling means; and wherein said output sliver thickness values are average error values derived by said sampling means integrating the output sliver thickness values at said second sliver measuring means over each of a plurality of said equal sliver path unit lengths, and averaged by said averaging means operating on the integrated values outputted from said sampling means.

6. An autoleveller according to claim 4, wherein said control means reduces the gain of said draft correction signal when the input and output thickness errors are of an opposite polarity and increases the gain of said draft correction signal when they are of like polarity.

7. An autoleveller according to claim 3, wherein said first sliver thickness measuring means is upstream of said drafting means.

8. An autoleveller according to claim 3, further comprising a coiler, wherein said second sliver thickness measuring means is positioned in the coiler head.

9. An autoleveller according to claim 8, further comprising a carding machine having a web condensing system, said autoleveller being positioned downstream of said web condensing system.

10. A method of autolevelling sliver, comprising:

measuring the thickness of a sliver in an autolevelling system for drafting sliver and generating a sliver thickness signal responsive thereto;

effecting a sliver thickness correction by changing the draft of the sliver in a drafting zone in response to the measured sliver thickness;

effecting a gain for the sliver thickness correction signal;

varying the gain of the sliver thickness correction signal in response to a measurement of the thickness of the sliver after drafting; and correcting draft of the sliver in response to the average of said measured sliver thickness over a predetermined length of the sliver path.

11. A method according to claim 10, wherein the averaging of the thickness signals is achieved by integrating the sliver thickness signal values to effect integrated values in each of the plurality of unit lengths of said sliver path, and averaging the integrated values.

12. A method according to claim 10, wherein the thickness measurements are taken at two spaced apart locations, a first location upstream of said drafting zone and a second location downstream thereof; wherein the sliver thickness signals from each of said spaced apart locations are separately integrated over said plurality of path unit lengths and averaged over said predetermined sliver path length to derive an input sliver thickness error relative to a target thickness value at said first location; and an output sliver thickness error relative to a target thickness value at said second location, and wherein the gain of a draft correction based on the measured sliver length at said first location is increased when the input sliver thickness error has the same sign as the output sliver thickness error and is decreased when the input and output sliver thickness errors have opposite signs.

13. A method according to claim 12, wherein said first sliver thickness correction is imposed with a time delay to make said first sliver thickness correction effective on a part of the sliver which was at said first location at the instant of measuring the sliver thickness signal value in response to which the instantaneous draft was computed.

14. A method according to claim 12, wherein each said incremental sliver length is 1 meter and 100 meters of sliver are averaged to form an averaged input, said averaged input being delivered to a comparator associated with said autolevelling system.

15. An autoleveller for drafting sliver along a sliver path, comprising:

drafting means for drafting a sliver to be autolevelled;

first sliver thickness measuring means associated with the sliver path for sensing deviations in thickness from a predetermined thickness in the sliver path capable of generating positive and negative input sliver thickness error signals responsive thereto;

second sliver thickness measuring means associated with the sliver path for sensing the deviations in thickness from a predetermined thickness in the sliver path capable of generating positive and negative output sliver thickness error signals responsive thereto;

draft varying means connected to said first sliver thickness measuring means and said drafting means for varying the draft of said drafting means to correct sliver thickness deviations sensed by said first sliver thickness measuring means;

control means associated with said draft varying means for controlling said draft varying means in response the signals from said first sliver thickness measuring means;

averaging means associated with said control means and responsive to said second sliver measuring means for averaging sliver thickness error signals from said second sliver measuring means over a known length of the sliver path, said averaging means generating averaged thickness values responsive to the averaging of said sliver thickness error signals; and said control means delivering a draft correction signal to said draft varying means responsive to said averaging means, such that the gain of said draft correction signal is reduced when said sliver thickness error signals from said first and second sliver measuring means are of an opposite polarity and the gain of said draft correction signal is increased when said sliver thickness error signals from said first and second sliver measuring means are of a like polarity.

* * * * *